US005644881A

United States Patent [19]

Neilly

[11] Patent Number: 5,644,881

[45] Date of Patent: Jul. 8, 1997

[54] WINDOW FRAME WITH INTEGRAL CONNECTORS

[75] Inventor: Albert J. Neilly, Holland, Mich.

[73] Assignee: ODL, Incorporated, Zeeland, Mich.

[21] Appl. No.: 556,806

[22] Filed: Nov. 2, 1995

[51] Int. Cl.[6] ..... F06B 3/68

[52] U.S. Cl. ..... 52/455; 52/213; 52/585.1; 52/656.5; 49/505

[58] Field of Search ..... 52/455, 204.5, 52/211, 212, 213, 217, 656.5, 656.4, 656.9; 49/504, 505

[56] References Cited

U.S. PATENT DOCUMENTS

| | | | |
|---|---|---|---|
| 3,191,727 | 6/1965 | Schmeltz . | |
| 3,760,543 | 9/1973 | McAllister . | |
| 3,903,669 | 9/1975 | Pease, Jr. et al. . | |
| 4,021,967 | 5/1977 | Mulder . | |
| 4,306,373 | 12/1981 | Chatani . | |
| 4,523,408 | 6/1985 | McConnell | 49/505 X |
| 4,735,025 | 4/1988 | Day | 52/217 |
| 4,919,635 | 4/1990 | Bertrand . | |
| 4,920,718 | 5/1990 | Aranick et al. | 52/656.4 X |
| 4,989,381 | 2/1991 | De Block et al. | 52/656.5 X |
| 4,996,814 | 3/1991 | Guillemet | 52/217 X |
| 5,133,168 | 7/1992 | Neilly et al. . | |
| 5,233,802 | 8/1993 | Rogers | 52/212 |

FOREIGN PATENT DOCUMENTS

| | | | |
|---|---|---|---|
| 0574344 | 12/1993 | European Pat. Off. | 52/213 |
| 2539363 | 3/1976 | Germany | 52/212 |

*Primary Examiner*—Carl D. Friedman
*Assistant Examiner*—Winnie Yip
*Attorney, Agent, or Firm*—Warner Norcross & Judd

[57] ABSTRACT

A window assembly having a pair of window frame halves each including a plurality of screw bosses. The screw bosses are arranged to align in male/female pairs when the frame halves are brought together in proper alignment. The mating male and female screw bosses are frictionally interfitted to releasably intersecure the frame halves during storage, transportation, and installation.

18 Claims, 3 Drawing Sheets

WINDOW FRAME WITH INTEGRAL CONNECTORS

BACKGROUND OF THE INVENTION

The present invention relates to window frame connectors for temporarily intersecuring a pair of window frame halves during storage, transportation, and installation.

Window assemblies are typically manufactured at one location and installed, for example in a door, at another location. A relatively simple window assembly includes an insulated glass and a pair of frame halves. The window assembly is installed by sandwiching both the glass and the article in which the glass is to be supported between the two frame halves. When installed in a door, this type of window assembly is referred to as a door light.

The insulated glass includes a pair of transparent panes separated by and hermetically sealed to a spacer frame. The space between the panes can be occupied by air or by a gas selected for its functional characteristics. Alternatively, the space can be evacuated to improve the thermal characteristics of the glass. Desiccant is provided within the spacer frame to absorb moisture between the panes. Relative slippage of the glass panes must be avoided to prevent rupture of the hermetic seal. Rupture of the seal will permit moisture to enter the space or gas to leave the space. Either occurrence can severely impair the function and/or aesthetics of the window.

It is well known that slippage of the panes during transportation can be reduced or eliminated by firmly sandwiching the insulated glass between the frame halves. This can be done by intersecuring the frame halves using the mounting screws. However, this is labor intensive. First, the screws must be fully inserted during assembly, then removed for separation of the frame halves for installation in an article, and then reinserted and tightened after the window is installed in the desired article.

The frame halves can also be interconnected during transportation using a temporary window frame connector. A particularly ingenious connector is shown in U.S. Pat. No. 5,133,168 issued Jul. 28, 1992 to Neilly et al and entitled WINDOW FRAME CONNECTOR. This connector is a generally tubular body that fits over screw bosses on the opposite frame halves to securely align and interconnect the halves for storage and/or transportation. The connector is bifurcated at opposite ends to provide a "clothes-pin" action and to fit over ribs supporting the screw bosses.

Connectors, in general, can increase the overall cost of the window assembly because they must be manufactured, installed, removed, and either disposed or recycled.

SUMMARY OF THE INVENTION

The aforementioned problems are overcome in the present invention wherein a window frame is provided with integral connectors to temporarily intersecure the frame halves during storage, transportation, and installation.

The frame halves include mating connectors that mechanically interfit with one another, for example by a friction fit, to temporarily intersecure the frame halves. As specifically disclosed, each pair of connectors includes a male connector half and a female connector half. In a specific embodiment, the connectors can be screw bosses.

The present invention provides a simple and effective connector that securely aligns and intersecures the window assembly. The connectors are formed integrally with the frame halves thereby requiring no additional manufacture, installation, removal, and disposal steps. Further, because they are not removed, the integral connectors help to align and to intersecure the frame halves during installation.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
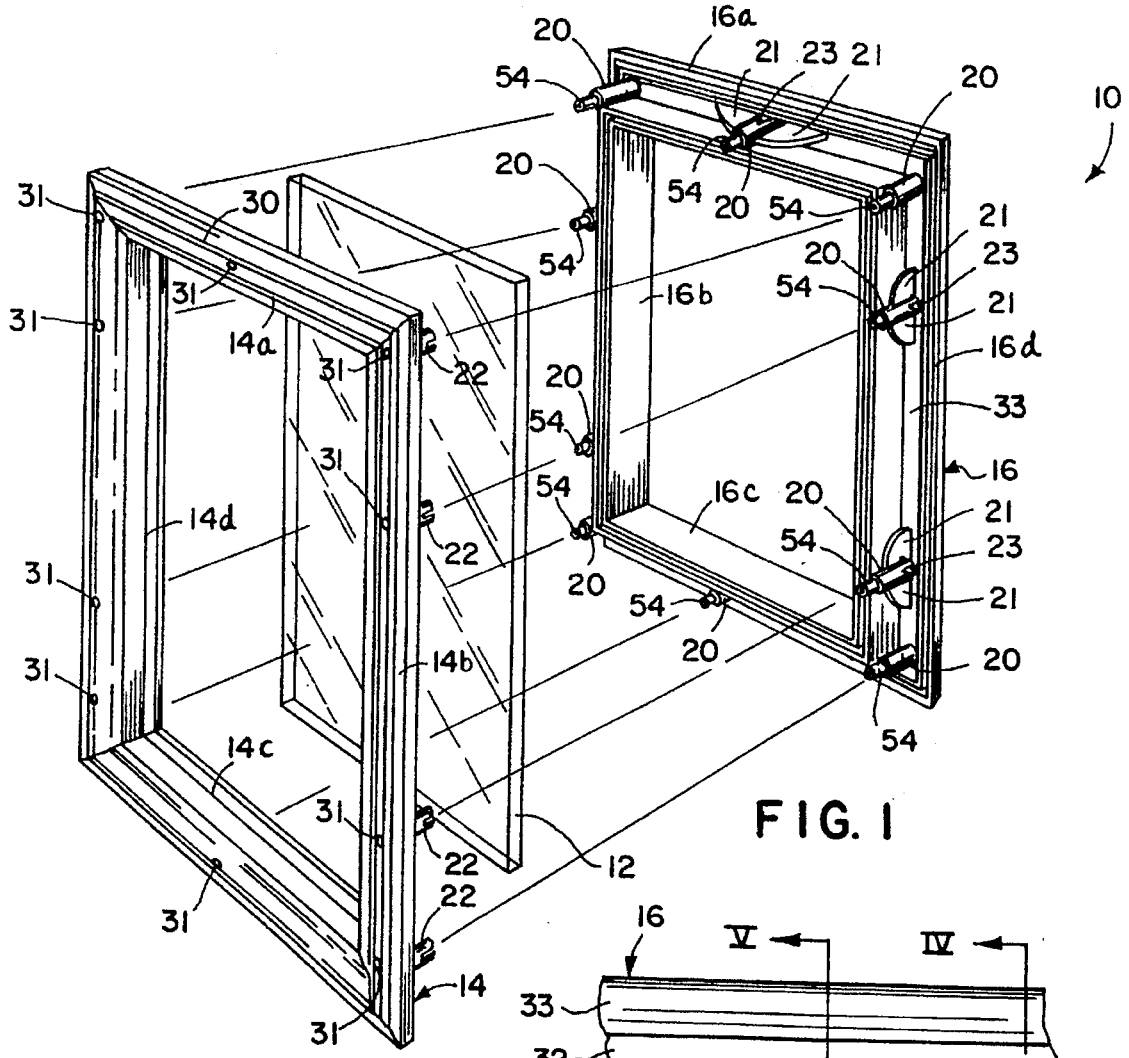
FIG. 1 is a perspective exploded view of the window assembly including the integral window frame connectors.
Figure 3:
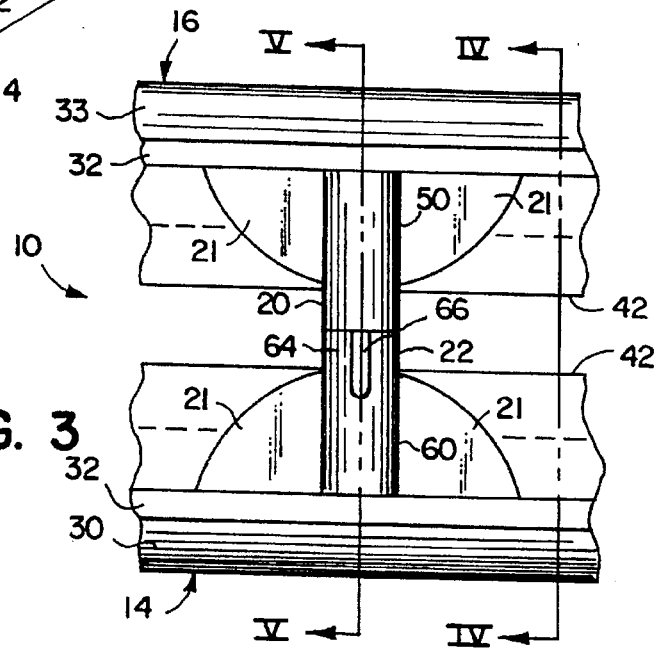
FIG. 3 is a side elevational view of a portion of the interconnected frame halves.
Figure 2:
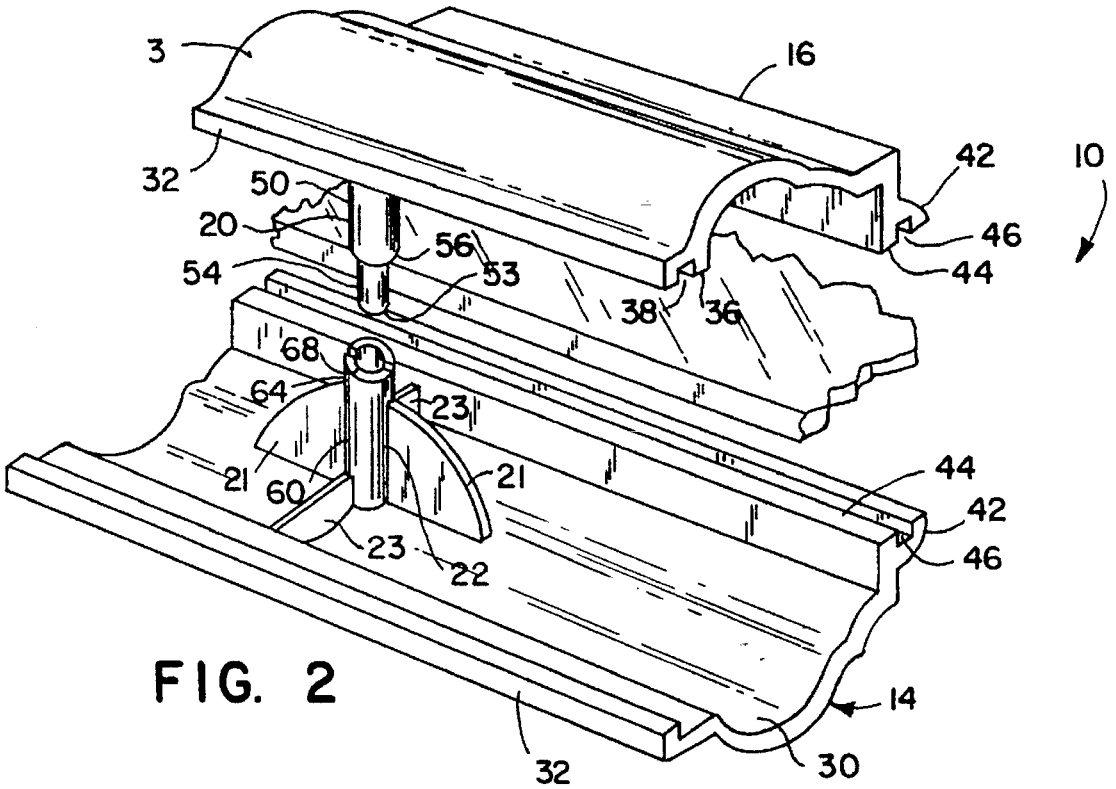
FIG. 2 is a perspective exploded view of a portion of the frame halves.
Figure 4:
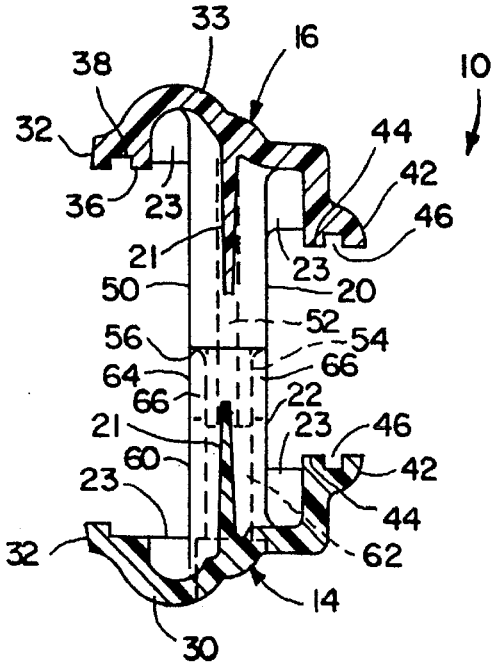
FIG. 4 is a sectional view of the interconnected frame halves taken along line IV—IV in FIG. 3.

A window assembly according to a preferred embodiment of the present invention is illustrated in FIG. 1, and generally designated 10. The assembly includes an insulated glass panel 12 sandwiched between an inside frame half 14 and an outside frame half 16. The window halves 14 and 16 include opposed male and female screw bosses 20 and 22, which receive screws (not shown) to secure the window assembly within an article, such as a door. The male screw boss 20 includes a pin 54 that is frictionally received within the female screw boss 22 to temporarily align and intersecure the frame halves. The female screw boss 22 is preferably split or bifurcated to enhance flexibility.

The opposed screw bosses interfit to temporarily, but securely, align and interconnect the frame halves to hold the assembly together during transportation, storage, and installation without glass slippage. By way of disclosure, and not by way of limitation, the present invention is described in conjunction with a door. The window assembly 10 is well suited for installation in other articles, such as walls.

The inside frame half 14 includes four integral wall segments 14*a–d* that form a rectangular opening. Each wall segment includes an outer wall 30 and a plurality of integral female screw bosses 22. A plurality of screw holes 31 are defined about the outer wall 30 in concentric alignment with the female screw bosses 22. The screw holes 31 are countersunk to seat the head of the mounting screws (not shown). A conventional screw hole plug (not shown) can be fitted within the screw holes to hide the screw. The outer wall 30 and female screw bosses 22 are preferably manufactured from conventional polymeric materials. With the exception of female screw bosses 22, the inside frame half 14 is generally conventional. The outer wall 30 is shaped to provide the desired appearance.

The outside frame half 16 includes four integral wall segments 16*a–d* that are interconnected to form a rectangular opening. The wall segments 16*a–d* of the outside frame half 16 each include an outer wall 33 and a plurality of male screw bosses 20. Again, the outer wall 33 and male screw bosses 20 are preferably manufactured from conventional polymeric materials. The outer wall 33 is preferably shaped to match outer wall 30. However, it can be shaped differently from outer wall 30 if desired.

Both outer walls 30 and 33 include a plurality of screw boss support ribs 21 and 23. Support ribs 21 are parallel to the longitudinal direction of the outer wall 30, while support ribs 23 are perpendicular to the longitudinal direction of the outer wall 30. The support ribs 21 and 23 strengthen and support the screw bosses 20 and 22.

Figure 5:
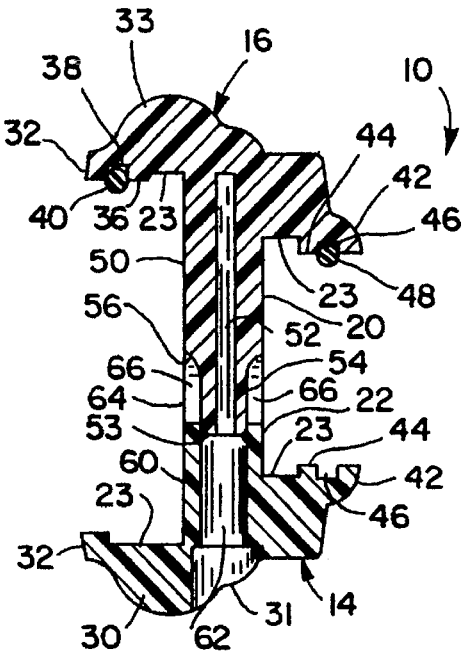
FIG. 5 is a sectional view of the interconnected frame halves taken along line V—V in FIG. 3.

A door-engagement flange 32 extends from the outer longitudinal edge of each outer wall 30 and 33. The flange 32 engages the door (not shown) to support the window assembly 10 within the door. A peripheral tongue 36 extends from outer wall 33 in spaced apart relation from the door-engagement flange 32. The door-engagement flange 32 and tongue 36 cooperate to define a groove 38 for seating a gasket 40 (see FIG. 5).

The outer walls 30 and 33 further include a glass-engagement flange 42. The glass-engagement flange 42 extends from the inner longitudinal edge of each outer wall 30 and 33 to engage and support the glass panel 12. A peripheral tongue 44 extends from each outer wall 30 and 33 in spaced apart relation to the glass-engagement flange 42. The glass-engagement flange 42 and tongue 44 cooperate to define a groove 46. Groove 46 on the outside frame half 16 is used for seating a gasket 48 (see FIG. 5).

Turning more specifically to the screw bosses, the male and female screw bosses 20 and 22 are arranged so that male/female pairs are aligned when the inside frame half 14 is properly positioned over the outside frame half 16.

The male and female screw bosses 20 and 22 are preferably manufactured as an integral part of the outer walls 30 and 33. The male screw boss 20 includes a generally tubular body 50 extending substantially perpendicularly from the outer wall 33. The tubular body 50 includes a pin 54 extending from shoulder 56. The pin 54 is fitted within the opposed female screw boss 22 to frictionally intersecure the frame halves. An internal bore 52 is defined concentrically through tubular body 50 and pin 54 to threadedly receive a mounting screw (not shown) for interconnecting the frame halves 14 and 16 within the door (not shown). The pin 54 includes a rounded tip 53 to facilitate insertion into the female screw boss 22. Shoulder 56 is substantially flat to fit squarely against the end of the female screw boss 22.

The female screw boss 22 includes a generally tubular body 60 having an external diameter substantially equal to that of screw boss 20. The tubular body 60 extends substantially perpendicularly from the outer wall 30 in concentric alignment with screw hole 31. The tubular body 60 defines an internal bore 62 having a diameter selected to frictionally receive pin 54. The female screw boss 22 includes an end portion 64 that is split or bifurcated to define a pair of longitudinal, diametrically opposed slots 66. The inner circumferential edge 68 of the tubular body 60 is rounded to facilitate installation as will be described below.

Manufacture and Use

Figure 6:
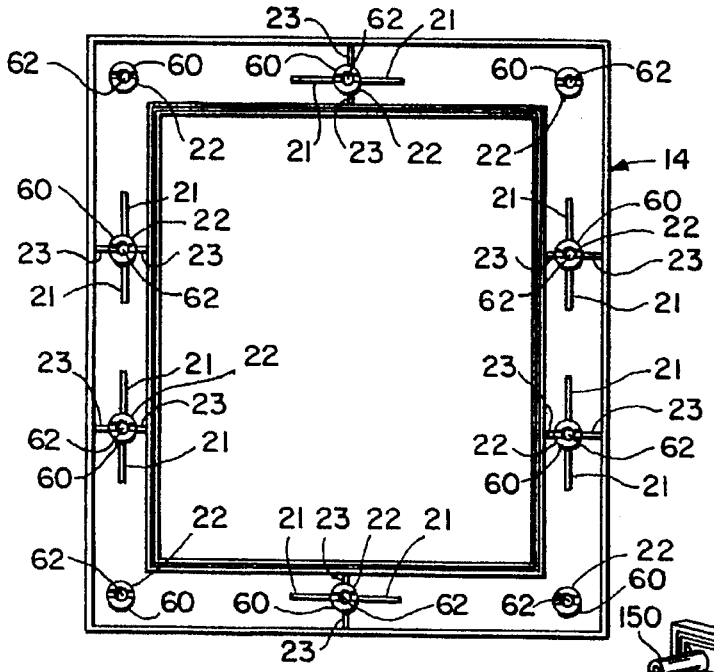
FIG. 6 is a from plan view of the window frame half.

The window frame 10 is manufactured using well-known techniques and apparatus, preferably by injection molding. As noted above, the two frame halves are generally conventional except for screw bosses 20 and 22. To properly interfit the frame halves, the male and female screw bosses 20 and 22 must be aligned. For example, as illustrated in FIG. 6, the female bosses 22 are spaced evenly around the inside frame half 14 while the male screw bosses 20 are identically spaced around the outside frame half 16. The illustrated screw boss arrangement is merely exemplary. The number and position of screw bosses can vary as desired. The insulated glass 12 is also manufactured using well-known techniques.

To assemble a window 10 for shipment, the outside frame half 16 is horizontally supported, for example on a table. Gaskets 40 and 48 are applied and seated in grooves 38 and 46, respectively (See FIG. 5). Gaskets 40 and 48 are manufactured from conventional materials, such as rubber or glazing materials. Gasket 48 is preferably adhesive. The insulated glass 12 is then laid in position on the frame half 16. Gasket 48 bonds and seals the insulated glass 12 to the outer frame half 16. Obviously, single-pane glass or other conventional glass may be substituted for the insulated glass if desired. Often, the male screw bosses 20 provide the lateral alignment of the insulated glass 12 on the frame half 16.

Next, the inside frame half 14 is aligned with the outside frame half 16. The inside frame half 14 must be properly oriented to achieve proper alignment. When so aligned, the opposed screw bosses will be aligned in male/female pairs. Once aligned, the inside frame half 14 is pushed down toward the outside frame half 16 so that each pin 54 of each male screw boss 20 is frictionally fitted within the internal bore 62 of the opposed female screw boss 22. The rounded tip 53 of pin 54 and the rounded edge 68 of the female screw boss 22 will facilitate insertion. The inside frame half 14 is pushed down until shoulder 56 firmly engages the end of the female screw boss 22. The interfitted screw bosses firmly, but temporarily, intersecure the two frame halves.

If desired, the assembled window can be banded or strapped to further hold the window components together. The window assembly can also be boxed or otherwise packaged to protect it from damage during storage or installation. The window assembly is stored and eventually shipped to a location for installation within an article, such as a door.

Prior to installation within a door, all packaging and/or banding is removed from the window assembly, and the window frame halves 14 and 16 are separated. The outer frame half 16 with the insulated glass 12 bonded to it is positioned within the window opening of the door (not shown) from the exterior side. The inner frame half 14 is positioned on the opposite side of the door (the interior) in alignment with the outer frame half 16. The frame halves 14 and 16 are pushed together firmly so that pins 54 are reseated within internal bores 62. The mating screw bosses 20 and 22 frictionally intersecure the two frame halves 14 and 16. Mounting screws (not shown) are then inserted into screw holes 31 and through bores 62. The mounting screws (not shown) are then screwed into bores 52 to permanently intersecure the frame halves 14 and 16. The screws are tightened to compress gaskets 40 and 48 to provide a leak-tight seal around the window assembly 10. A conventional screw hole plug (not shown) can be fitted within each screw hole 31 to hide the screw.

Alternative Embodiment

Figure 7:
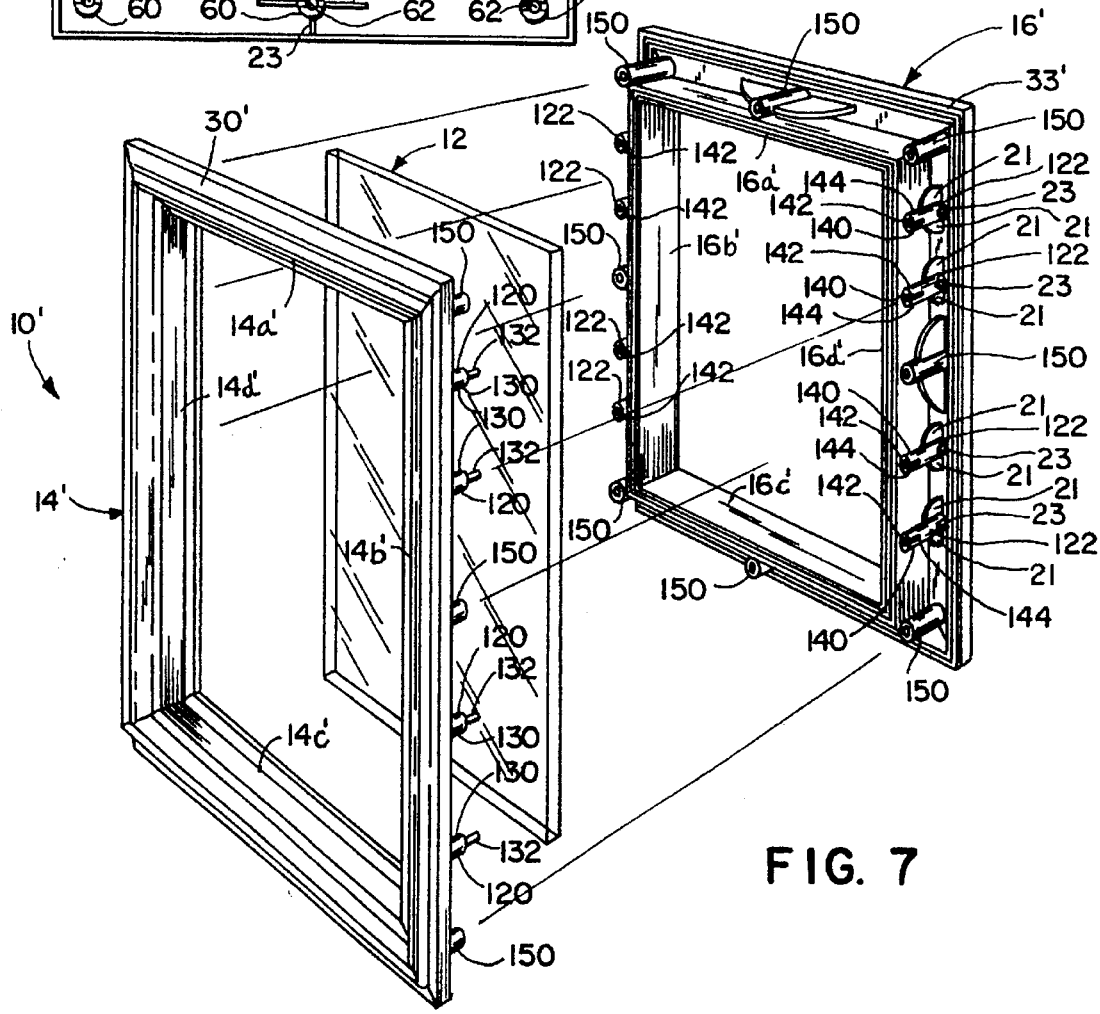
FIG. 7 is a sectional view similar to FIG. 5 showing an alternative integral frame connector.

In the alternative embodiment illustrated in FIG. 7, the window assembly 10' includes integral male and female connectors or connector halves 120 and 122 that do not receive screws. The connectors 120 and 122 are arranged in mating pairs which are interfitted to temporarily intersecure the window frame halves. The window frame 10' includes conventional screw bosses 150 to permanently intersecure the two frame halves using conventional mounting screws.

The connectors 120 and 122 are preferably spaced evenly along the longitudinal extent of wall segments 14*b'*, 14*d'*and 16*b'*, 16*d'*extending from outer walls 30' and 33', respectively, between the screw bosses 150. The number and location of connectors can vary depending on the desired retention to be provided by the connectors.

The connectors 120 and 122 are similar in structure to the screw bosses 20 and 22 described in connection with the first embodiment described above and are supported by ribs similar to ribs 21 and 23. The male connector 120 includes a tubular body 130 and a pin 132. The tubular body 130 preferably defines a bore to prevent a depression of sink mark from forming in the outer wall 30' when the frame half 14' cools after molding. The female connector 122 includes a tubular body 140 defining an internal bore 142. The end portion 144 of the tubular body 140 is preferably split or bifurcated to enhance flexibility. The pin 132 is frictionally seated within the internal bore 142 in a manner identical to that of the pin 54 and internal bore 62 of the first embodiment. The mating connectors temporarily intersecure the two frame halves 14' and 16' for storage, transportation, and installation.

The above descriptions are those of preferred embodiments of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A window frame comprising:

a first frame half including a plurality of integral, one-piece first connector halves; and a second frame half intersecured with said first frame half by a fastening means, said second frame half including a plurality of integral, one-piece second connector halves, each of said one-piece second connector halves being aligned with and frictionally intersecured within one of said one-piece first connector halves to define a pair to releasable intersecure said first and second frame halves together in the absence of said fastening means; and said fastening means passing through said first and second connector halves for securing said pair of frame halves together.

2. The window frame of claim 1 wherein one of said one-piece connector halves in each said pair comprises a female screw boss and the other of said one-piece connector halves comprises a male screw boss frictionally fitted within said female screw boss.

3. The window frame of claim 2 wherein each of said male screw bosses includes a pin and each of said female screw bosses includes an internal bore adapted to frictionally receive one of said pins.

4. The window frame of claim 3 wherein each of said screw bosses defines a screw hole.

5. The window frame of claim 4 wherein each of said female screw bosses includes a bifurcated end.

6. The window frame of claim 6 wherein said pin includes a rounded tip facilitating insertion of said pin into said internal bore.

7. The window frame of claim 6 wherein said female screw boss includes a rounded inner edge facilitating insertion of said pin into said internal bore.

8. A window assembly comprising:

a glass panel;

a first frame half including an outer wall and a plurality of integral, one-piece connector halves; and a second frame half intersecured with said first frame half by a fastening means, said second frame half including an outer wall and a plurality of integral, one-piece connector halves, said first and second frame halves disposed on opposite sides of said glass panel, said integral, one-piece connector halves of said first frame half being uniquely paired and frictionally interfitted with said integral, one-piece connecter halves of said second frame half to releasably intersecure said frame halves together in the absence of said fastening means; and said fastening means passing through said connector halves of said first and second frame halves for securing said two halves together.

9. The window assembly of claim 8 wherein said connector halves of said first frame half includes a plurality of one-piece male connector halves and said connector halves of said second frame half includes a plurality of female one-piece connector halves, each of said one-piece male connector halves of said first frame half being uniquely paired and interfitted with one of said one-piece female connector halves of said second frame half.

10. The window assembly of claim 9 wherein each of one-piece said male connector halves includes a pine and each of said one-piece female connector halves includes an internal bore adapted to frictionally receive one of said pins.

11. The window assembly of claim 10 wherein said outer wall includes support ribs for supporting said male connector halves and said female connector halves.

12. The window assembly of claim 11 wherein said internal bore for receives a mounting screw, said mounting screw threadedly engaging at least one of said one-piece connector halves.

13. The window assembly of claim 12 wherein each of said outer walls defines a screw hole in concentric alignment with each of said internal bores.

14. The window assembly of claim 13 wherein each of said one-piece female connector halves includes a bifurcated upper end.

15. The window assembly of claim 15 wherein said pin includes a rounded tip, said rounded tip facilitating insertion of said pin into said internal bore.

16. The window assembly of claim 15 wherein said one-piece female connector halves each include a rounded inner edge, said rounded inner edge facilitating insertion of said pin into said internal bore.

17. A window assembly comprising:

a pair of frame halves intersecured by a fastener, said pair of frames including a first frame half including an integral, one-piece male elongated boss and a second frame half including an integral, one-piece female boss axially aligned with said male boss of the first frame half, the elongated male boss of first frame half being frictionally received and intersecured within the female boss of the second frame half to releasably intersecure said frame halves together in the absence of said fastener; and a panel supported by said frame halves;

said fastening means passing through said bosses of said first and second frame halves for securing said two frame halves together.

18. The window assembly of claim 17 wherein the elongated boss of one frame half includes a pin and the elongated boss of the other frame half includes a bore frictionally receiving said pin.

* * * * *

UNITED STATES PATENT AND TRADEMARK OFFICE

CERTIFICATE OF CORRECTION

PATENT NO. : 5,644,881

DATED : July 8, 1997

INVENTOR(S) : Albert J. Neilly

It is certified that error appears in the above-indentified patent and that said Letters Patent is hereby corrected as shown below:

Column 5, Claim 1, Line 39:
"releasable" should be --releasably--

Column 5, Claim 6, Line 58:
"6" should be --5--

Column 6, Claim 8, Line 14:
after "two" insert --frame--

Column 6, Claim 10, Line 24:
"pine" should be --pin--

Column 6, Claim 12, Line 31:
after "bore" delete --for--

Column 6, Claim 15, Line 40:
"15" should be --14--

Signed and Sealed this

Tenth Day of November 1998

*Attest:*

*Attesting Officer*

BRUCE LEHMAN

*Commissioner of Patents and Trademarks*